US005511352A

United States Patent [19]

Sholton

[11] Patent Number: 5,511,352

[45] Date of Patent: Apr. 30, 1996

[54] OPERABLE GLASS BLOCK WINDOW

[75] Inventor: Bernard C. Sholton, Coral Gables, Fla.

[73] Assignee: Glenn Sholton, Coral Gables, Fla.

[21] Appl. No.: 811,769

[22] Filed: Dec. 20, 1991

[51] Int. Cl.[6] ..... E04B 5/46

[52] U.S. Cl. ..... 52/306; 49/501; 52/474

[58] Field of Search ..... 52/304, 306, 307, 52/308, 474, 475, 476, 477; 49/501, 171

[56] References Cited

U.S. PATENT DOCUMENTS

| | | | |
|---|---|---|---|
| 2,835,623 | 5/1958 | Vincent et al. . | |
| 2,972,783 | 2/1961 | Russell et al. . | |
| 4,058,943 | 11/1977 | Sturgull | 52/307 X |
| 4,689,933 | 9/1977 | Biro | 52/475 X |
| 4,831,804 | 5/1989 | Sayer | 52/475 |
| 4,843,772 | 7/1989 | Lisa et al. | 52/308 |
| 4,949,506 | 8/1990 | Durham, Jr. | 52/475 X |
| 4,986,048 | 1/1991 | McMarlin | 52/306 |
| 5,014,471 | 5/1991 | Ballstadt | 52/308 X |
| 5,042,210 | 8/1991 | Taylor | 52/307 |
| 5,079,886 | 1/1992 | Downs | 52/308 |
| 5,187,909 | 2/1993 | Olson | 52/210 |

FOREIGN PATENT DOCUMENTS 1912628 3/1965 Germany .

OTHER PUBLICATIONS

Four pages from the 1992 edition of Sweet's Catalog.
Architectural Record's Product Report, p. 71, Dec. 1991 issue.

*Primary Examiner*—Xien T. Nguyen
*Attorney, Agent, or Firm*—Kirkpatrick & Lockhart

[57] ABSTRACT

An operable glass block window comprises a window frame sized for insertion into an opening in a structure. A window sash is provided which carries a plurality of glass blocks. The glass blocks are connected to one another to form a rigid panel, and the panel is connected to the window sash to form an integral structure. Hinges or pivots are provided for connecting the sash to the frame to allow the sash to move relative to the frame.

8 Claims, 6 Drawing Sheets

OPERABLE GLASS BLOCK WINDOW

BACKGROUND OF THE INVENTION

1. Field of the Invention

The present invention is directed generally to the art of building construction and more specifically to operable windows used in building construction.

2. Description of the Invention Background

Glass blocks have been widely used for decades in the construction industry as partitions, exterior walls, and windows in buildings of all kinds. Glass block windows offer a variety of advantages over conventional, operable (i.e., openable) windows. For example, glass block windows have been widely used for protection against vandalism or break-ins. Glass block windows also offer protection against the elements, particularly hurricanes and other violent storms. Because of the construction of glass blocks, glass block windows are energy efficient and they also reduce the transmission of noise from the outside to the interior of the building.

Glass block windows may be constructed by cementing, or otherwise permanently connecting, a number of glass blocks together to form a panel of an appropriate size for the desired opening. The panel of glass blocks is then permanently affixed in the opening. It is precisely because of that rigid, permanent, panel construction that many of the above-identified advantages are possible. However, it is also because of that rigid, permanent and fixed attachment of the panel to the surrounding structure that glass block windows suffer from a number of disadvantages.

Because of the impossibility of opening a glass block window, fire codes may prohibit their use particularly when there is only one window in a room and no other safe fire escape is available as proscribed by law. Additionally, the inability to open a glass block window obviously prohibits venting of a room to let in fresh air. Although vents can be installed in a glass block window, they interfere with the aesthetic value of the glass block window. Finally, because of the fixed attachment of the panel to the surrounding structure, it is impossible to clean the outside of the glass block window from the interior of the structure.

Thus, the need exists for a glass block window which is capable of functioning as a traditional operable window while retaining the desirable features of a glass block window.

SUMMARY OF THE INVENTION

The present invention is directed to an operable glass block window comprising a window frame sized for insertion into an opening in a structure. A window sash is provided which carries a plurality of glass blocks. Hinges connect the sash to the frame to allow the sash to move relative to the frame. In one embodiment of the present invention, the sash is capable of moving relative to the frame so as to form an angle of at least ninety degrees therebetween.

The operable glass block window of the present invention provides the advantages of traditional, fixed, glass block windows. That is, the glass block window of the present invention provides protection against vandalism as well as break-ins. The glass block-window of the present invention provides excellent protection against hurricanes and other gale force winds. Glass block windows constructed according to the teachings of the present invention are also energy efficient and reduce the transmission of noise from the outside to the interior of the building.

Because the glass block windows of the present invention are capable of being opened, they provide the required fire exits and, thus, their use is not prohibited by fire codes. Because the glass block window can be fully opened to a position where the window sash forms an angle of ninety degrees with the window frame, maximum ventilation is achieved. Additionally, the ability to open the window to such a degree allows easy access to the outside of the window from the inside of the room for convenient and safe cleaning. Those, and other advantages and benefits of the present invention, will become apparent from the Description of a Preferred Embodiment hereinbelow.

BRIEF DESCRIPTION OF THE DRAWINGS

For the present invention to be clearly understood and readily practiced, it will now be described in conjunction with the following figures wherein.

DESCRIPTION OF THE PREFERRED EMBODIMENT

Figure 1:
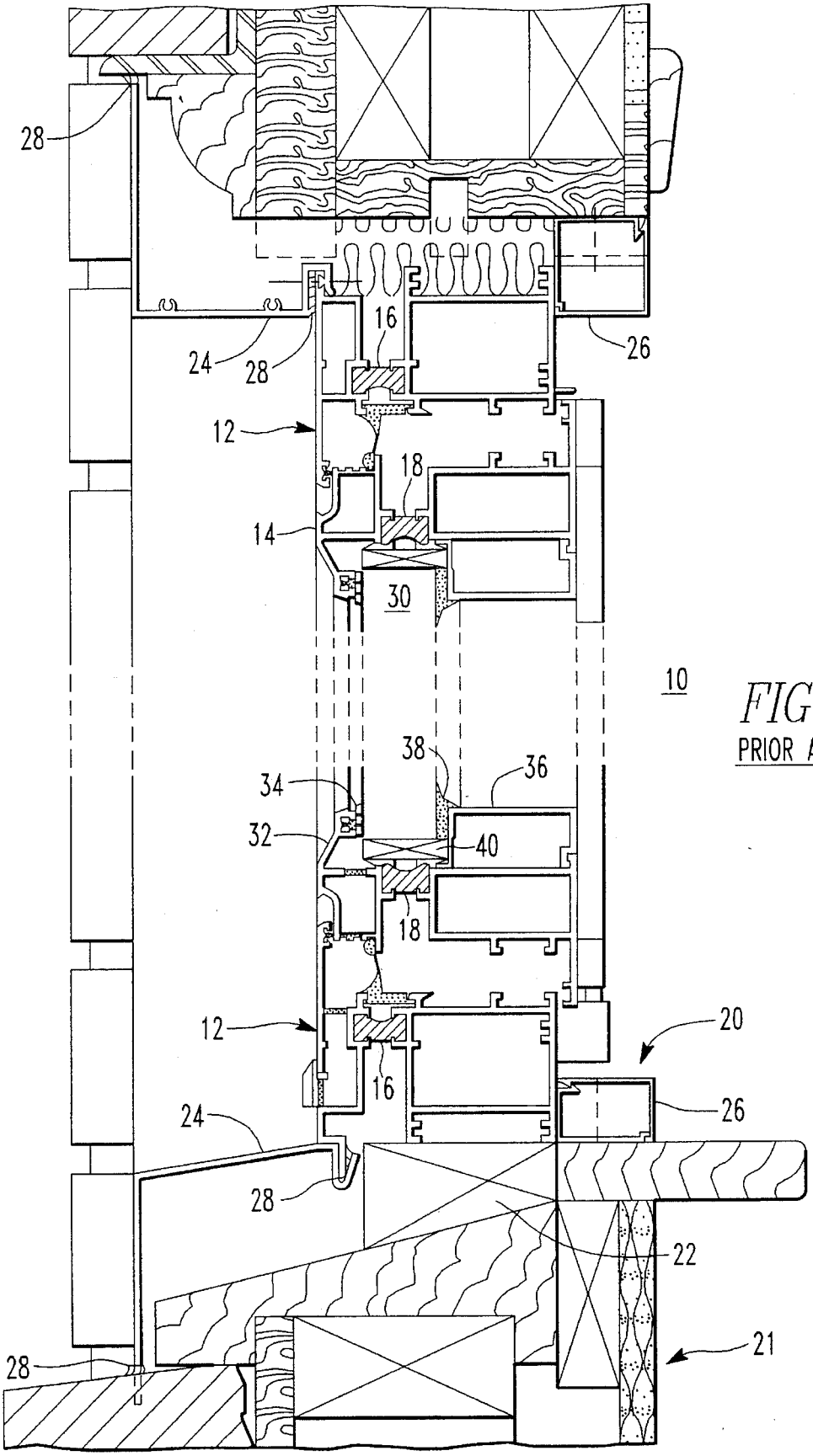
FIG. 1 PRIOR ART
FIG. 1 is cross-sectional view of a window constructed according to the teachings of the prior art.

FIG. 1 illustrates a cross sectional view of a window 10 constructed according to the teachings of the prior art. The window 10 is comprised of two basic components, a generally rectangular window frame 12 and a generally rectangular window sash 14. Both the window frame 12 and the window sash 14 may be extruded aluminum, tubular, thermally broken frames. The thermal break in the window frame 12 occurs at a polyurethane strip 16. The thermal break in the window sash 14 occurs at a polyurethane strip 18.

As is known in the art, the window 10 is sized to fit into a generally rectangular, or square, opening 20 in a structure 21. As is known, the window frame 12 may rest upon continuous blocking 22. Exterior panning 24 is provided in the transition area between the window frame 12 and the exterior of structure 21. Interior trim 26 is similarly provided in the transition area between the window frame 12 and structure 21. A sealant 28 is provided between the window frame 12 and the exterior panning 24 to effect a weather tight seal between the window frame 12 and the exterior panning 24. The sealant 28 is also applied between the exterior panning 24 and the structure 21 to affect a weather tight seal between the exterior panning 24 and the structure 21.

The window sash 14 is constructed to have a flange member 32 extending around the perimeter of the exterior surface. The flange member 32 is designed to carry a dry glazing strip 34 which acts as a compression seal as will be described momentarily. The window sash 14 is designed to receive along its interior perimeter a snap-in glazing bead 36. The snap-in glazing bead 36 cooperates with a glazing wedge 38 to urge a pane of glass 30 against dry glazing strip 34 and flange member 32. Through that mechanism, the pane of glass 30 is carried by the window sash 14 in a weather tight manner inasmuch as dry glazing strip 34 is held in compression between flange member 32 and the pane of glass 30.

Finally, the window sash 14 may carry neoprene spacers 40 to properly align the pane of glass 30 within the window sash 14.

An example of the type of window described in conjunction with FIG. 1 is the model TR-10,000 window available from Traco, which is located in the Cranberry Industrial Park, Box 805, Warrendale, Pa. 15095. In the Traco TR-10, 000 window, the pane of glass 30 carried by the window sash 14 may be one inch thick.

Figure 5:
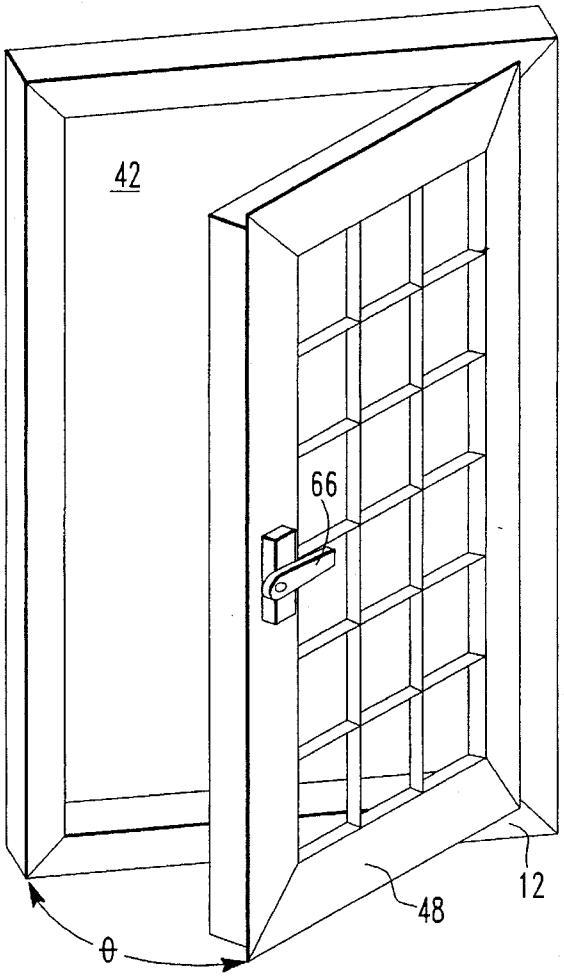
FIGS. 5, 6, and 7 illustrate various ways in which the window of the present invention may be opened.
Figure 6:
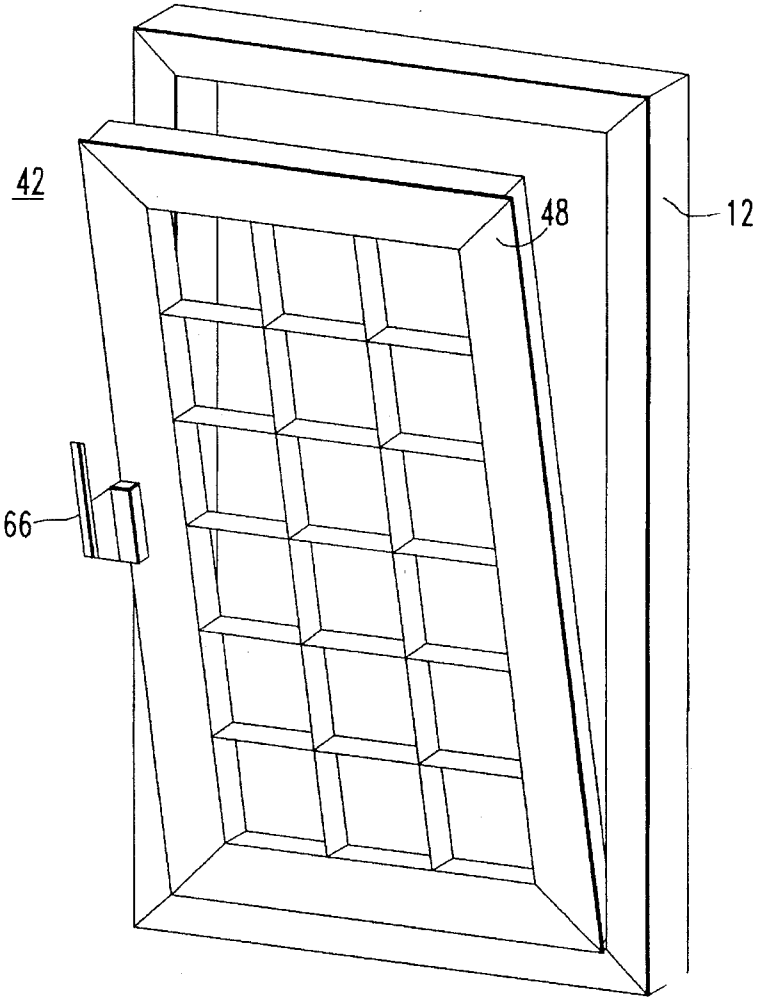

The prior art window illustrated in FIG. 1 may be provided with dual action hardware (not shown). Dual action hardware, such as the JET AS 130 available from G. U. Hardware of 11761 Rock Landing Drive, Suite M6, Newport News, Va. 23606 or the Roto ALU100 available from Wilh. Frank GmbH of P.O. Box 100158, D-7022 Leinfelden-Echterdingen, Germany is well-known in the art and allows the prior art window 10 of FIG. 1 to be opened like a door, as illustrated in FIG. 5, or to be opened like a vent, as illustrated in FIG. 6. Although such dual action hardware may be desirable, or even necessary in particular markets, the dual action hardware is well-known in the art and does not form a part of the present invention.

Figure 2:
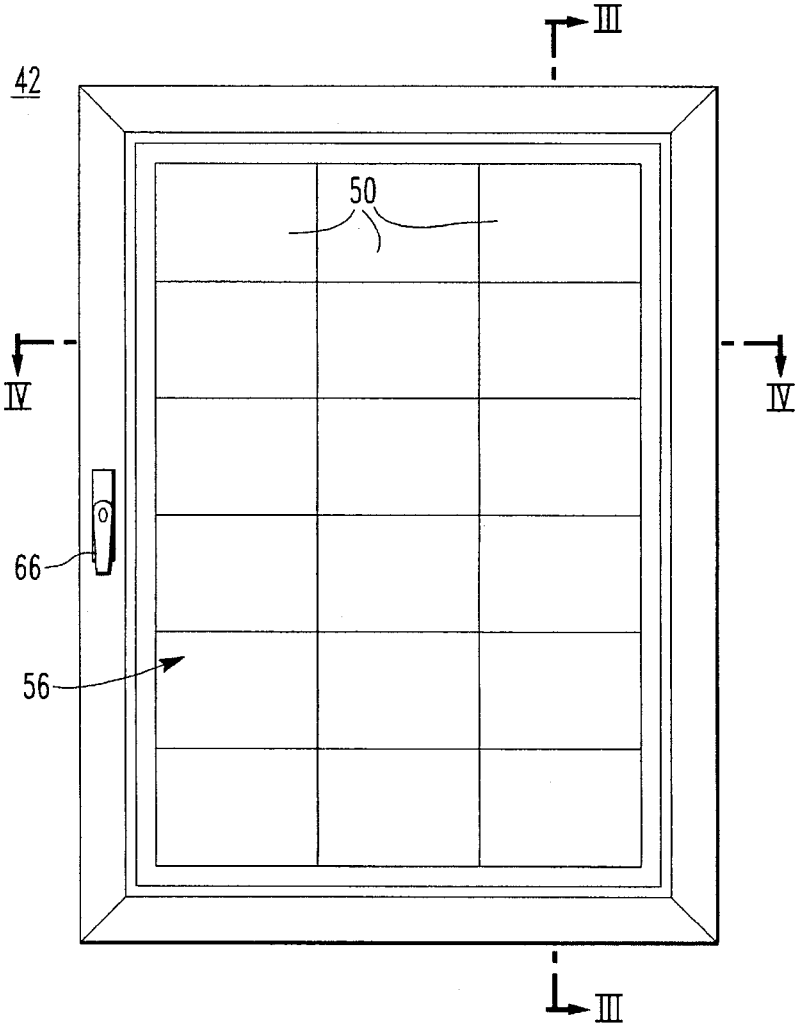
FIG. 2 is an elevational view of a window constructed according to the teachings of the present invention.
Figure 3:
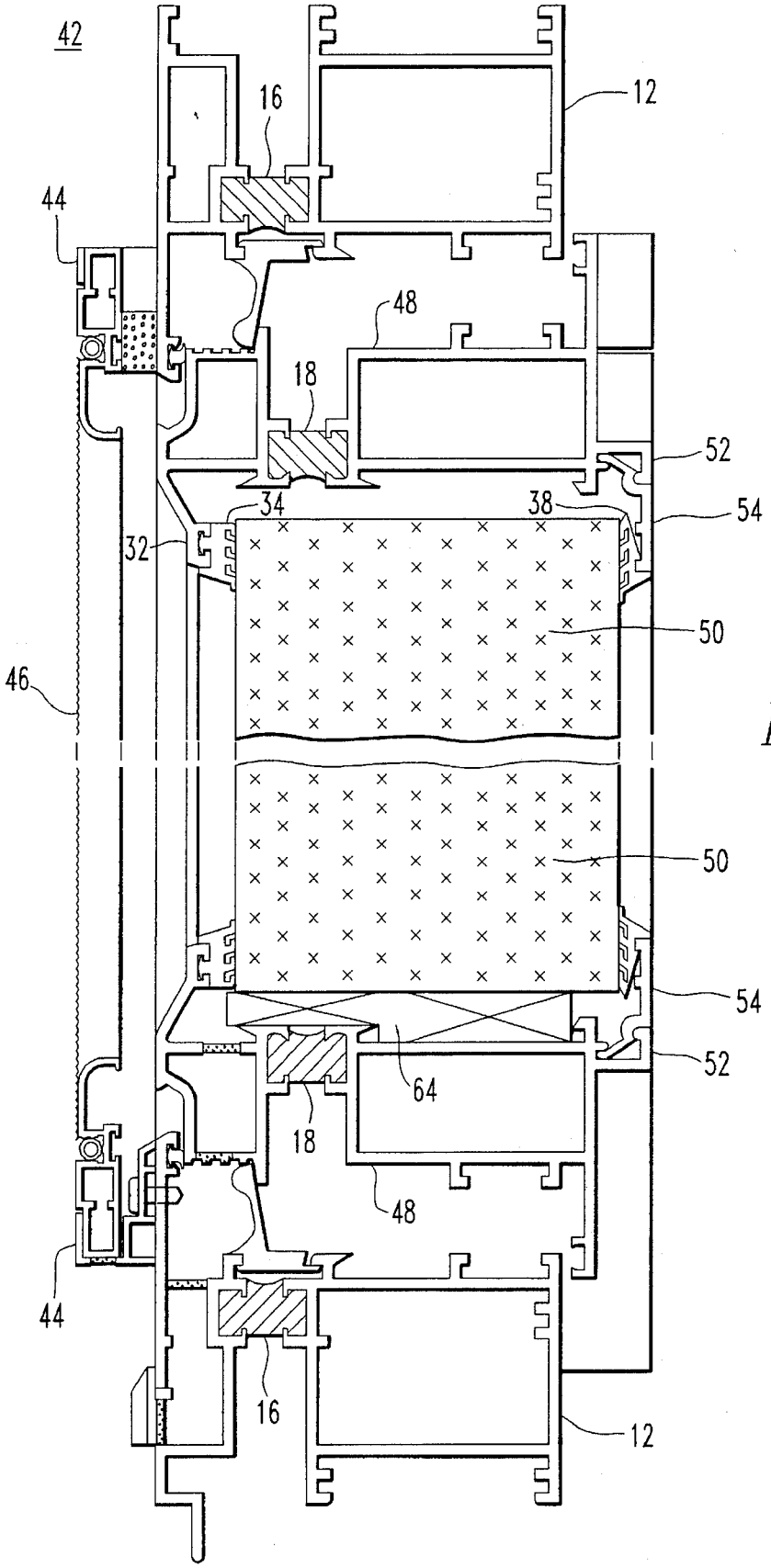
FIG. 3 is a cross-sectional view of the window of FIG. 2 taken along the lines III—III.
Figure 4:
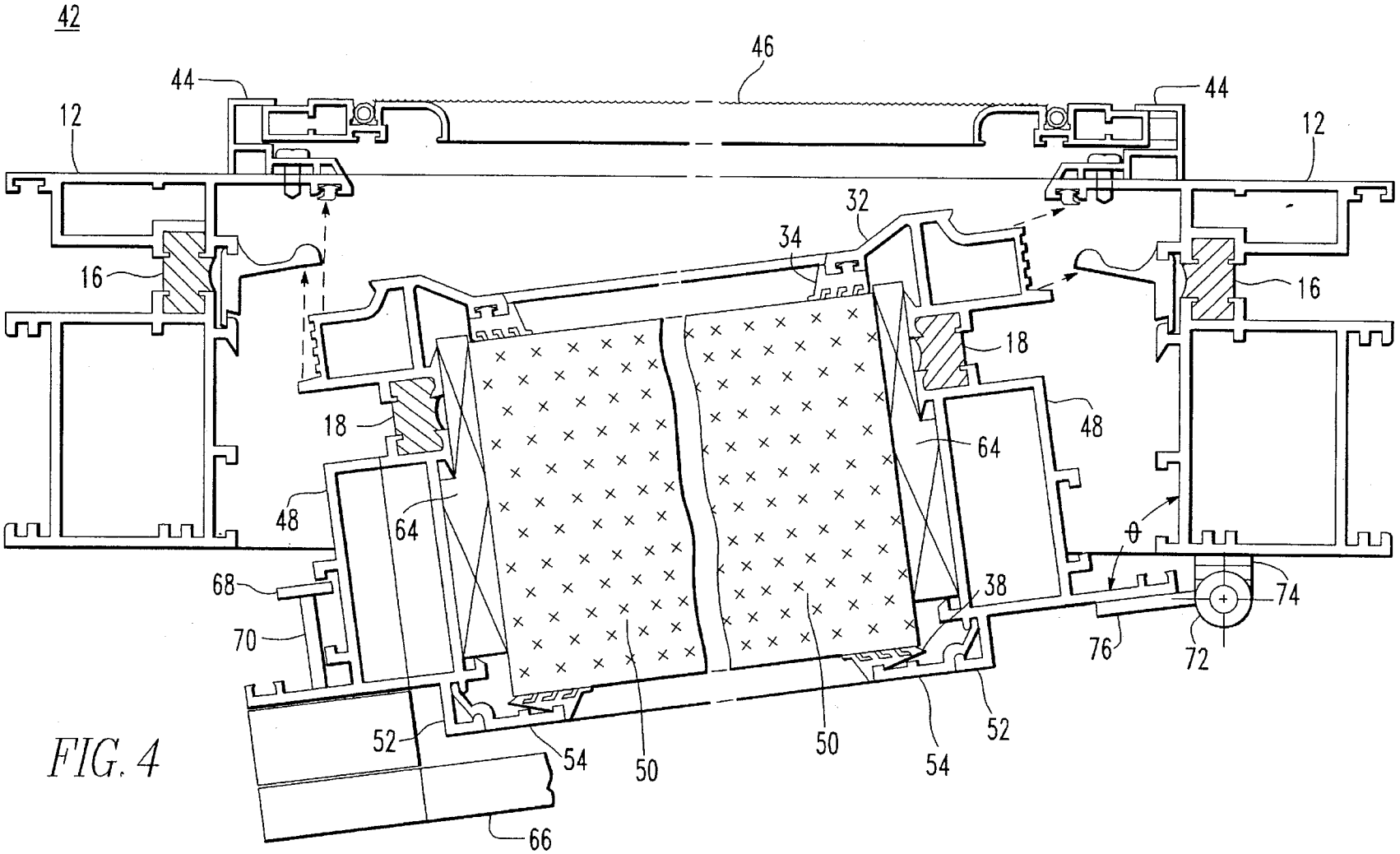
FIG. 4 is a cross-sectional view of the window of FIG. 2 taken along the lines IV—IV but with the window partially opened.

Turning now to FIG. 2, an elevational view of a window 42 constructed according to the teachings of the present invention is illustrated. Details of the window 42 may be seen in FIG. 3, which is a cross-sectional view taken along the lines III—III of FIG. 2, and FIG. 4, which is a cross-sectional view taken along the lines IV—IV of FIG. 2 but with the window 42 partially open. In FIGS. 3 and 4, components performing the same function as components of the prior art window 10 carry the same reference numeral.

As seen in FIGS. 3 and 4, the window frame 12 of the window 42 of the present invention serves the same function as discussed in conjunction with FIG. 1. The window frame 12 carries a lip member 44 around its outer periphery which is designed to receive a screen 46 in a conventional manner. Because the window 42 can be opened, screen 46 is a desirable, although not essential, feature.

One of the primary areas of difference between the window 42 of the present invention and the window 10 of the prior art resides in construction differences between a window sash 48 of the window 42 of the present invention and the window sash 14 of the prior art window 10. The window sash 48 of the window 42 is a generally rectangular or square, extruded aluminum, tubular, thermally broken sash with the thermal break provided by the polyurethane strip 18.

To accommodate the width of a plurality of glass blocks 50 which are carried by sash 48, sash 48 carries a lip member 52 which protrudes from the interior perimeter of the sash 48. The lip 52 is sized to receive a snap-in glazing bead 54. The snap-in glazing bead 54 cooperates with the glazing wedge 38 to urge glass blocks 50 against the dry glazing strip 34 and flange 32 thus retaining the glass blocks 50 within the sash 48. The lip member 52 provides the extra width necessary to enable the sash 48 to carry the glass blocks 50, which are substantially thicker than the one inch glass pane carried by the prior art window 10 of FIG. 1. Typical thicknesses of glass blocks which may be used in the window 42 of the present invention are as follows:

American Regular Sizes—Nominal (in inches)
4×8×4
6×6×4
8×8×4
12×12×4

Metric Sizes—Actual (in mm)
190×190×80
240×240×80
240×115×80
115×115×80
300×300×100

All sizes of glass blocks are available from Solaris U.S.A. of 6915 S. W. 57th Ave., Coral Gables, Miami, Fla. 33143, including the four Trimline blocks which are particularly well suited for use in the present invention:

TRIMLINE BLOCKS—Nominal (in inches)
4×8×3
6×6×3
6×8×3
8×8×3

The glass blocks identified above may be used in any number or combination to produce a panel 56 as seen in FIG. 2. The panel 56 of glass blocks 50 may be constructed in a traditional manner whereby each of the individual glass blocks 50 is rigidly attached to adjacent glass blocks through the use of a traditional mortar material. The panel 56 of glass blocks 50 may first be constructed and then inserted as a single member into the window sash 48 or, alternatively, the panel 56 may be constructed block by block in the window sash 48. In lieu of the traditional mortar material, an epoxy based mortar, structural silicon, or other motarless systems may be used. However, a combination of two materials may be used as shown in FIG. 8.

Figure 8:
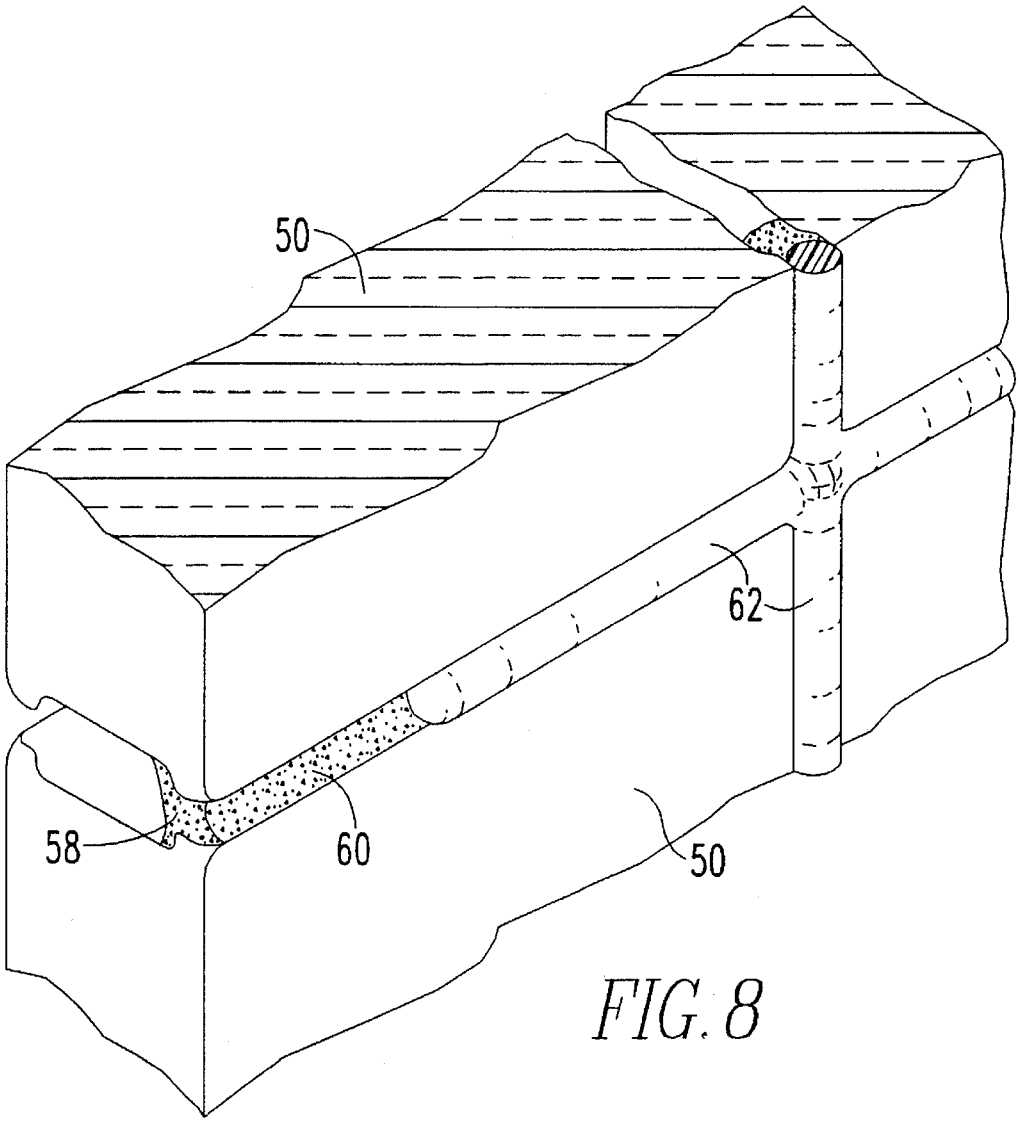
FIG. 8 illustrates a mortar/silicone joint between two adjacent glass blocks.

In FIG. 8, two adjacent glass blocks 50 and a portion of a traditional mortar joint 58 therebetween are illustrated. The thickness of the mortar joint is on the order of one-quarter inch. As is known, mortar contains water and requires approximately twenty eight days to completely cure. Before curing, a concave surface 60 may be formed in the mortar joint 58. Thereafter, the concave surface 60 may be filled with a silicon sealant 62 or coated with a water repellant masonry stain to seal the mortar joint 58 to prevent the leeching of any material from the mortar joint 58. Although it is desirable to seal the mortar joint 58 on the side of the panel 56 which will be exposed to the elements, the joints on the side of the panel 56 facing the interior of the building and at the bottom could also be sealed, if desired.

As stated, it is anticipated that the window 42 of the present invention may be constructed by first assembling the panel of glass blocks 56. After the panel of glass blocks 56 has been assembled, it may be inserted into the sash 48 using padding or spacers 64 of neoprene or other suitable resilient material positioned at the bottom and along the sides of the sash 48. No spacer is provided in the top of the sash 48 to provide a head space to allow for movement of the structure and/or expansion or contraction of surrounding structural elements. The neoprene spacers may be provided in a variety of sizes to account for variations in size of the glass block panels 56. Once installed, it is anticipated that the flange member 32 and snap-in glazing bead 54 of the sash 48 will cover only a minimum of the glass block surface, for example, approximately one-half inch.

As is known, glass blocks are substantially heavy. Accordingly, the window frame 12 and window sash 48 must be constructed to carry the weight of the panel 56. It is anticipated that extruded aluminum of a thickness of 0.080 inches and a width of approximately 3.25 inches can be used to construct the window frame 12 and window sash 48 of the present invention. Those of ordinary skill in the art will recognize that materials other than extruded aluminum can be used provided that the material can withstand the weight of the glass blocks. For a rectangular sash 48 size of three feet by five feet, the weight of the sash and the glass blocks should not exceed two hundred and sixty pounds.

A window 42 constructed of the aforementioned extruded aluminum is anticipated to have a sound transmission coefficient as high as forty and pressure equalization for twenty PSF water resistance.

Completing the description of the window 42, window sash 48 carries a handle 66 which is connected to a latching bar 68 through a shaft 70. A pair of hinges 72, one of which is visible in FIG. 4, has a first portion 74 connected to the window frame 12 and a second portion 76 connected to the sash 48. In that manner, rotation of the handle 66 causes rotation of the latching bar 68 which, upon reaching proper orientation, allows the sash 48 to swing inwardly, by virtue of the hinges 72, with respect to the window frame 12 as seen in FIG. 5. The sash 48 thus forms an angle Θ with respect to the window frame 12.

Figure 7:
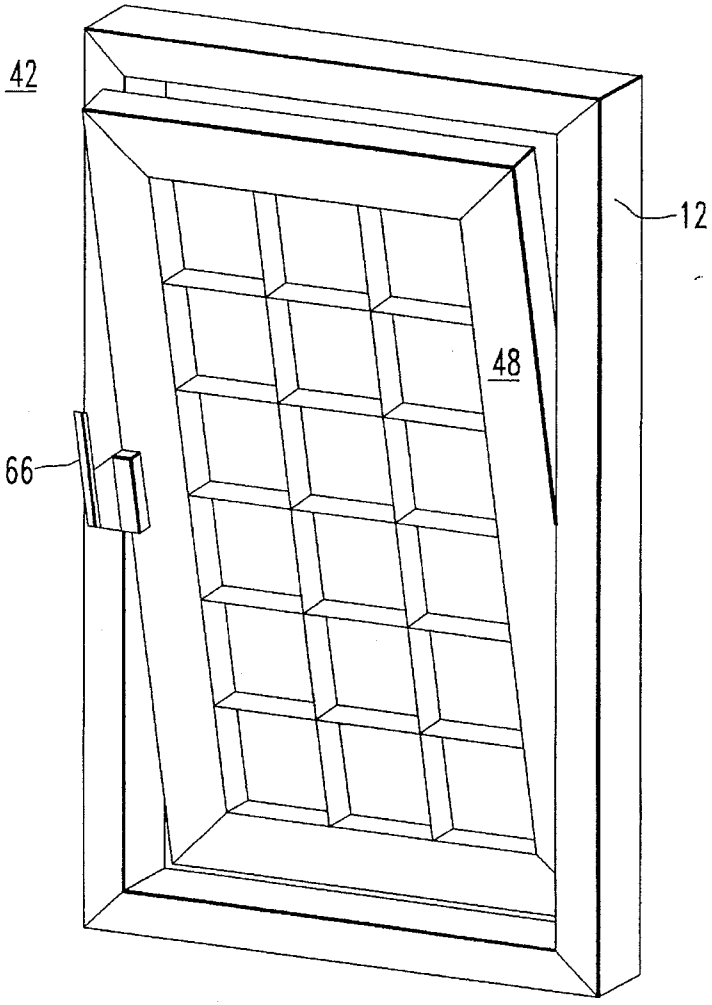

Of course, the window 42 need not be limited to opening in the manner as illustrated in FIG. 5. If the window 42 is provided with the dual action hardware described above, the window 42 may be opened as illustrated in FIG. 5 and as illustrated in FIG. 6 depending upon the position of the handle 66. Alternatively, centrally located pivot rods (not shown) may be provided to allow the window sash 48 to pivot with respect to window frame 12 as illustrated in FIG. 7. Thus, it is anticipated that the window of the present invention may take the form of inswing and outswing casement windows, top-hinged inswing windows, drop-head inswing windows, vertically pivoted windows, among others.

In the window 42 of the present invention, the plurality of glass blocks 50 are not connected to the window frame 12 or structure 21 as is done in the prior art, but are connected to a specially designed operable sash 48. Thus, the glass block panel 56 becomes an integral part of an openable window instead of being integrated directly into the structure 21 containing the window opening 20.

Because the window of the present invention may be constructed in a manner which allows the window frame and window sash to form an angle e of at least ninety degrees, the window 42 of the present invention contrasts dramatically with the closed-in, locked-in feeling associated with conventional glass block windows. The possibility of opening the window 42 of the present invention with the same convenience taken for granted in the case of windows constructed of panes of glass is unheard of with respect to glass block windows of the prior art. Because the window 42 of the present invention can be opened, it qualifies as a fire escape opening which has been impossible for glass block windows of the prior art. The glass block window 42 of the present invention can withstand hurricane or gale force winds which ordinarily cannot be withstood by the glass of the usual window panes. Additionally, the window 42 of the present invention provides security against vandalism and break-ins. Finally, because of the ability to open the window 42, the exterior of the window can be safely and conveniently cleaned from the interior of the building. Thus, the glass block window 42 of the present invention combines all of the unique benefits of prior art glass block windows with the benefits of traditional windows made of panes of glass. That represents a substantial advance over the art.

While the present invention has been described in conjunction with a preferred embodiment, those of ordinary skill in the art will recognize that many changes and modifications can be made to the preferred embodiment described herein. All such changes and modifications are intended to be covered by the foregoing description and the following claims.

What is claimed is:

1. An operable glass block window, comprising:

window frame means sized for insertion into an opening in a structure;

a plurality of glass blocks interconnected to form a panel;

resilient spacer means;

window sash means having an exterior flange and an interior lip, said window sash means being of sufficient depth and strength for carrying said panel of glass blocks as a glazing material, said window sash means being of sufficient height and width to carry said resilient spacer means at the bottom thereof in a manner to support said panel of glass blocks and to allow for expansion of said panel of glass blocks on the other three sides;

a glazing strip positioned between said exterior flange and said panel of glass blocks;

a glazing wedge;

a glazing bead, said glazing bead and said glazing wedge being positioned to cooperate with said interior lip to urge said panel of glass blocks against said glazing strip and said exterior flange to form a weather tight seal; and means for connecting said sash means to said frame means, said means for connecting being of sufficient strength so as to allow said sash means to move relative to said frame means.

2. The operable glass block window of claim 1 wherein said means for connecting includes a plurality of hinges connected to both said window sash means and said window frame means to allow said sash means to assume an angle of at least ninety degrees with respect to said frame means.

3. The operable glass block window of claim 2 wherein said window sash means is of sufficient height and width to provide an egress window.

4. The operable glass block window of claim 1 wherein said plurality of glass blocks are interconnected by mortar so as to form a joint between each glass block, and wherein each of said joints is sealed.

5. The operable glass block window of claim 1 wherein said plurality of glass blocks are interconnected by a mortarless interconnection system.

6. The operable glass block window of claim 1 wherein said plurality of glass blocks are interconnected into a panel before insertion into said sash means.

7. The operable glass block window of claim 6 wherein said sash means is generally rectangular or square in shape and has a bottom member, two side members, and a top member, said operable glass block window additionally comprising a plurality of spacers located along said bottom member and said side members of said sash means.

8. The operable window of claim 1 wherein said glass block window frame means and said window sash means are constructed of extruded, tubular, aluminum.

* * * * *

UNITED STATES PATENT AND TRADEMARK OFFICE

CERTIFICATE OF CORRECTION

PATENT NO. : 5,511,352
DATED : April 30, 1996
INVENTOR(S) : Bernard C. Sholton

It is certified that error appears in the above-indentified patent and that said Letters Patent is hereby corrected as shown below:

Col. 5, line 45, delete "e", and substitute therefor --θ--.

Signed and Sealed this

Seventh Day of January, 1997

*Attest:*

*Attesting Officer*

BRUCE LEHMAN

*Commissioner of Patents and Trademarks*